United States Patent [19]

Gray

[11] 3,950,865

[45] Apr. 20, 1976

[54] SAFETY BOX TOE

[75] Inventor: B. Everett Gray, St. Louis, Mo.

[73] Assignee: Bata Shoe Company, Inc., Belcamp, Md.

[22] Filed: Apr. 8, 1975

[21] Appl. No.: 566,606

[52] U.S. Cl. ..... 36/77 R
[51] Int. Cl.[2] ..... A43C 13/14
[58] Field of Search ..... 36/77 R, 72 R

[56] References Cited

UNITED STATES PATENTS

| | | | |
|---|---|---|---|
| 1,823,924 | 9/1931 | Williams | 36/77 R |
| 2,111,536 | 3/1938 | Murray | 36/72 R |
| 2,151,554 | 3/1939 | Josephson | 36/77 R |
| 2,409,880 | 10/1946 | McMurray | 36/77 R |
| 2,537,891 | 1/1951 | Greenan | 36/77 R |
| 2,740,209 | 3/1956 | Shultz | 36/77 R |
| 3,325,922 | 6/1967 | Bray | 36/77 R |
| 3,593,438 | 7/1971 | Mitchell | 36/77 R |

*Primary Examiner*—Alfred R. Guest
*Attorney, Agent, or Firm*—Holman & Stern

[57] ABSTRACT

A safety box toe for use in shoes and the like having flange means on the lower edge thereof wherein the total of the horizontally projected areas of the flange means rearwardly of an imaginary transverse test axis one-half inch in front of the center back edge of the box toe is at least equal to the total of the horizontally projected areas of the flange means forwardly of that axis, with the maximum transverse width of the flange means on each side of the box toe element being no more than 20 percent of the overall maximum width of the box toe element. This "balanced flange" design provides improved compression and impact test result according to conventional standards.

6 Claims, 8 Drawing Figures

SAFETY BOX TOE

BACKGROUND OF THE INVENTION

1. Field of the Invention

This invention relates to an improved safety box toe for use in shoes and the like and relates more particularly to a relatively rigid stiffener or insert element formed in the toe area of a shoe to provide protection for the wearer.

It should be understood that although the following discussion will be directed primarily to incorporation of a safety box toe according to this invention into a shoe, the same inventive concepts relate to other types of footwear such as boots and the like.

2. Description of the Prior Art

Numerous prior art safety box toe designs have been developed heretofore primarily intended to protect the toes of the wearer against injury caused by external forces that come into contact with the toe portion of a shoe. Current standards of performance for safety footwear are described in the American National Standard Z-41.1-1967(R 1972), which is incorporated herein in its entirety by reference.

To define performance two types of force application are considered, namely impact and compression type forces. The former tends to simulate the resultant force of a falling object, while the latter simulates any relatively slow-moving object. The standard also recognizes that different industrial situations create different degrees of hazards. Three classes of hazards are defined in the standard as follows:

| CLASS | REQUIREMENTS FOR IMPACT | COMPRESSION |
|---|---|---|
| 30 | 30 ft-lbs. | 1,000 lbs. |
| 50 | 50 ft-lbs. | 1,750 lbs. |
| 75 | 75 ft-lbs. | 2,500 lbs. |

The standard specifies that any particular design or model must comply with both the impact and compression requirements for the given class while maintaining a minimum clearance under the safety toe box of one-half inch.

The conventional safety box toe shapes for safety footwear are designed to conform to the forward portion of the safety footwear last. All safety footwear are made over lasts which are a reproduction of the approximate shape of the human foot. The box toe are flanged to allow the box toe to conform to the last and to wrap around the last featherline, insole and lining if used, as a method of securing the safety box toe in the footwear. In conventionally designed safety box toes the flange is uniform in width and narrow providing a uniform horizontally projected area. This narrow uniform distribution of the projected area allows the safety box toe to rotate rearwardly under external forces resulting in a reduction of the toe clearance and also allowing a tendency for the flange edges to cut through the supporting soling materials.

In certain designs of safety box toes the flanges have been extended over the entire bottom portion of the box toe element or, alternatively, have been extended to form a strap-like element adjacent the rear edge of the box toe element. Such designs have produced a "guillotine" effect by clamping the toes of the wearer between the bottom element or strap and the upper portion of the safety box toe upon the application of an external force resulting in increased injury and great difficulty in removing the safety toe from the foot after impact.

While certain modifications of conventional box toe elements have resulted in non-uniform flange means, no recognition has been given heretofore to the tendency of a safety box toe to rotate rearwardly under the application of external forces, nor are any of the prior art designs presently available capable of overcoming this tendency.

Another difficulty with many prior art safety box toes is the tendency for the element to spread after application of a load, thereby again reducing the toe clearance upon impact or compression.

SUMMARY OF THE INVENTION

According to the instant inventive concepts a safety box toe is provided which overcomes the foregoing and other such disadvantages of the prior art.

More specifically, the safety box toe design of this invention, which for simplicity will be referred to herein as incorporating the "Balanced Flange" principle, not only increases the bearing area (a fact that will increase the resistance to external forces) of the safety box toe over the conventional design, but also distributes the projected flange area in a fashion that keeps the safety box toe from rotating downwardly at the rear edge. These two factors greatly improve the performance of safety box toes accordingly to this invention and the protection afforded the wearer's of safety footwear incorporating such elements.

The instant invention addresses itself in particular to three performance characteristics of safety box toes, namely:

1. The ratio of the bearing areas fore and aft of the force contact point, as particularly defined in the impact test outlined in the American National Standard set forth hereinabove;

2. The reinforcing of the toe flanges to reduce spreading; and

3. The limiting of the clamping (guillotine) effect on the toes of the wearer.

Experimentation has demonstrated that the safety box toe does, in fact, react as described previously. In order to obviate the reactions of normally designed safety box toes, a program of experimentation was followed for the last several years that has included the production of experimental box toe designs for the purpose of determining the optimum criteria for:

1. Preventing the rotation of the box down and toward the rear of the shoe, thus restricting the clearance of the box; and

2. Preventing the spreading of the box flanges.

Various types of designs were tried, including bracing of different constructions, varying flange dimensions and different combinations thereof. An engineering analysis indicates that the rotational problem is directly related to the area of the horizontal projection of the safety box toe flange in relation to the application of the external force. When the area of the projection is designed so that the portion of the flange projection forward of an axis line established as described in the foregoing American National Standard is equal to or less than the portion of the flange projection rearward of such axis, the force distribution and reactions are balanced in favor of minimizing the reduction of toe clearance.

The design of the instant invention, thus, not only prevents rotation of the box rear edge downwardly upon application of external forces, but also increases the bearing area of the box on the soling materials used in the footwear. The combination of these two factors substantially increases the protective quality of the shoes by increasing the resistance of the toe area to the reduction of toe clearance by external applied forces.

In addition, the widening of the flange according to this invention acts as an outstanding angle that stiffens the box and reduces the spreading of the rear flanges upon applications of load. The maximum width of the "Balanced Flange" according to this invention at the rear box edge should be limited to 20 per cent of the maximum width on each side of the box toe in order to preclude the clamping or (guillotine) effect referred to previously.

BRIEF DESCRIPTION OF THE DRAWINGS

Like reference characters refer to like parts throughout the several views of the drawings.

DETAILED DESCRIPTION OF THE PREFERRED EMBODIMENT AND COMPARISON TO THE PRIOR ART

Figure 1:
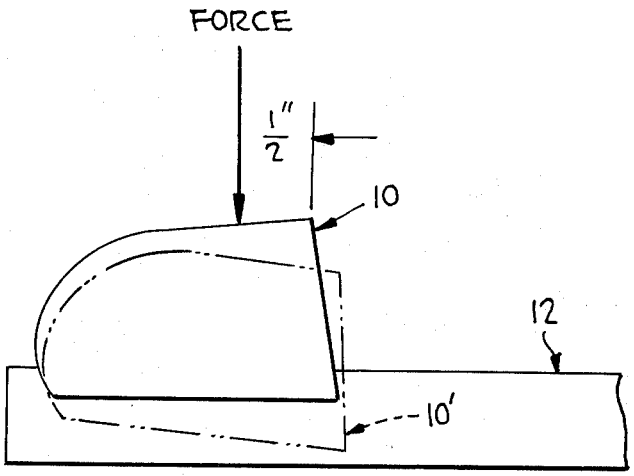
FIG. 1 PRIOR ART
FIG. 1 is a side elevational view of a prior art safety box toe, a portion of the sole being shown schematically, and the rotation of such box toe elements under application of external forces being illustrated in dotted lines.
Figure 2:
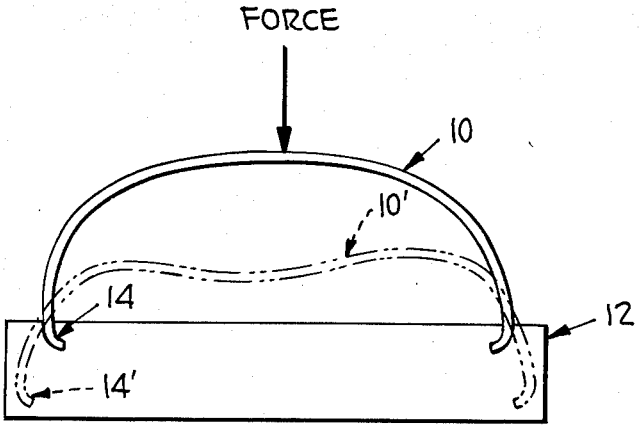
FIG. 2 PRIOR ART
FIG. 2 is a transverse cross sectional view through such a prior art safety box toe, showing in dotted lines the spreading of the flanges under application of an external force.
Figure 3:
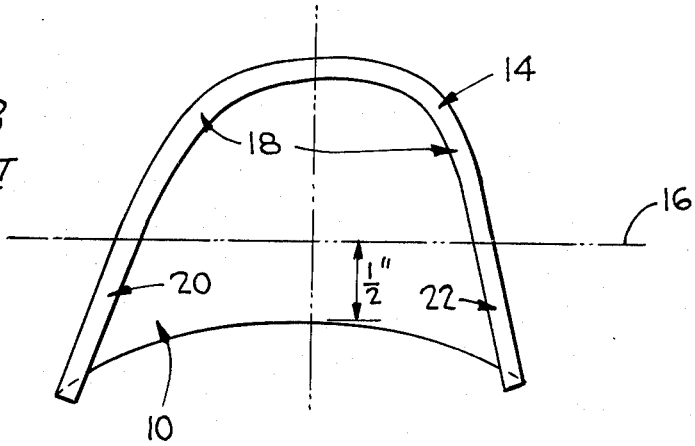
FIG. 3 PRIOR ART
FIG. 3 is a bottom plan view of a prior art safety box toe illustrating the projected area of the uniform flange, with the conventional impact test axis being shown in dot-dash lines.
Figure 4:
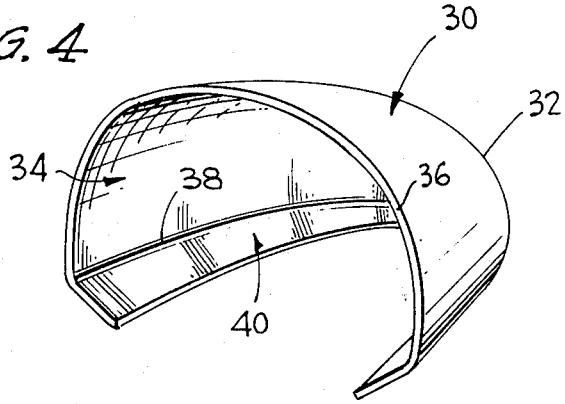
FIG. 4 is a perspective view of a safety box toe according to this invention incorporating the "Balanced Flange" principle.

Reference is made initially to FIGS. 1–3 which show a conventional prior art safety box toe designated generally by the reference numeral 10 and its relation to the sole of a shoe shown schematically at 12 in FIGS. 1 and 2. According to the foregoing American National Standard, a size 9D shoe is utilized for testing purposes and the impact test is conducted by dropping a weight on the center line of the element 10 one-half inch forwardly of the back edge thereof. The effect of the application of such a force to a conventional box toe design would be seen in dotted lines in FIGS. 1 and 2. From FIG. 1 it will be seen that the box toe element 10 rotates downwardly toward the rear thereby reducing the clearance between the inside of the box toe 10 and the sole 12 and, additionally, having a tendency, due to the narrow box toe flanges, to punch the safety box toe through the supporting soling materials.

In FIG. 2 it will be seen that the tendency of the conventional box toe element to spread under the application of an external force even further reduces the clearance available between the inside of the box toe element and the upper surface of the sole, this distortion and deformation further increasing the likelihood of injury to the wearer.

In FIG. 3 one can compare a horizontal projection of the flange areas of a conventional safety box toe 10, the flange means being designated generally by the reference numeral 14 and being seen to be relatively narrow and of uniform width throughout. The imaginary test axis is shown at 16 as dividing the flange means into a continuous portion 18 forwardly of the test axis 16 and a pair of portions 20, 22 rearwardly of this test axis. In conventional designs such as shown in FIGS. 1–3 the total of the horizontally projected areas 20+22 rearwardly of the test axis 16 is less than the total of the horizontally projected area 18 forwardly of the test axis 16. In other words, the ratio of the areas 20+22 divided by the area 18 is less than 1. It is this arrangement that results in the detrimental box rotation shown particularly in FIG. 1 with such prior art design.

Figure 5:
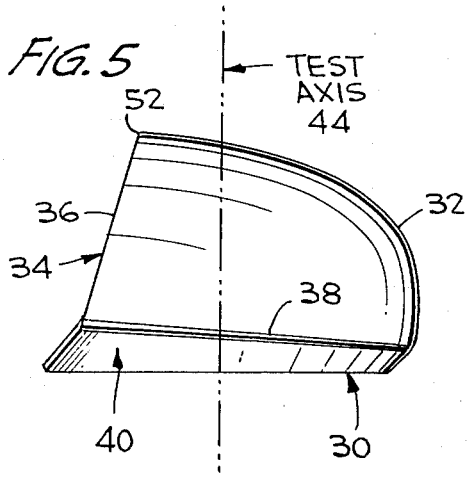
FIG. 5 is a side elevational view thereof showing the conventional impact test axis in dot-dash lines.
Figure 6:
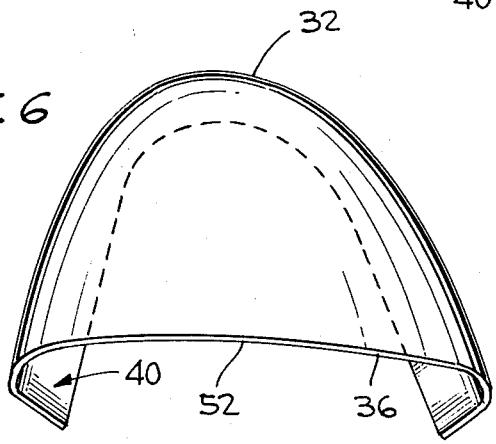
FIG. 6 is a top plan view of the improved safety box toe according to this invention.

In determining the areas both in the prior art design and in the construction according to the instant invention it should be recognized that the one-half inch measurement for the test axis is taken from the rear edge of the top of the safety box toe, rather than from the extreme flange edges. The plane of the back edge of the safety box is normally not vertical as will be seen in FIG. 1 and again in FIG. 5, since it slopes forwardly to allow clearance for comfort when the toe area of the safety shoe incorporating such a safety box toe is flexed as in walking or crouching. The axis determines the comparison of the projected areas of the flange and since the flange is of uniform width in the prior art embodiment of FIGS. 1–3, it makes no difference whether the lineal dimension or an areal dimension is used to calculate the ratio, this ratio invariably resulting in less than 1 in such prior art constructions.

Reference is now made to FIGS. 4–8 for a more detailed description of a safety box toe incorporating the "Balanced Flange" principle of the instant invention. This element is designated generally by the reference numeral 30 and as indicated previously can be made from various materials, including, but not limited to metals such as steel, and plastics, fabrics, nonwoven or combinations, depending upon the particular application. The "Balanced Flange" principle specifically improves the performance of a box toe when compared to conventional designs by maintaining greater toe clearance under the same force conditions for the wearer's toes irrespective of the box toe material, provided that this material will transfer energy to the flange means, or of the construction of the material utilized to manufacture the footwear. It will be understood therefore, that the use of the terminology "relatively rigid stiffener element" in the appended claims shall be interpreted to incorporate any materials having the foregoing properties.

The safety box toe element 30 has a closed front end portion 32 and an open rear end portion 34 terminating in a back edge 36. It will be seen that the element 30 is of a generally inverted U-shape in transverse cross section and includes lower edge portions 38 which in the embodiment shown are integrally connected to a continuous inwardly and downwardly extending flange means 40.

The box toe center line has been shown at 42 and the test axis has been shown at 44.

The distance 46 between the lowermost portions of the back edge 36 defines the overall or maximum width of the element 30 and the distances 48, 50 are the maximum transverse widths of the flange means 40 on each side of the element 30. Note, particularly, FIG. 7.

As indicated previously the test axis 44 according to the American National Standard for impact test is one-half inch forwardly of a point designated as 52 which is the intersection of the center line 42 with the back edge 56 and the highest point of the safety toe element 30.

Whole reference has been made to the one-half inch imaginary test axis referred to in the American National Standard, it is to be understood that the Balanced Flange principle as defined in this application is applicable regardless of the position of the test axis. Thus, if the American National Standard were to be revised hereafter, or if safety shoes were being manufactured for markets other than the United States where a different test axis was established, the same concepts could be applied to provide the advantages set forth in this application for safety box toes.

Figure 8:
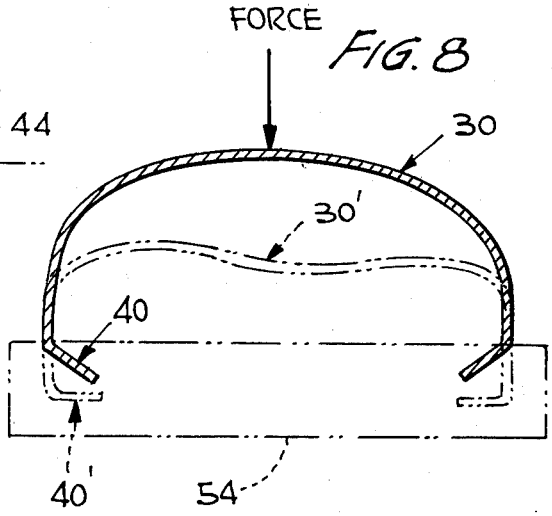
FIG. 8 is a transverse cross sectional view through the element of FIGS. 4–7 showing the effect of impact or compression and the reduction in spreading of the flanges caused by application of such external forces.

When a shoe having a safety toe element according to the instant inventive concepts is engaged by an external force as shown in FIG. 8 or in accordance with the test set forth in the American National Standard, no downward rearward rotation of the box occurs, either the box depressing vertically evenly or having a tendency to rotate downwardly toward the forward end thereby maintaining or producing a greater clearance than with conventionally designed box toes.

Moreover, as will be seen in FIG. 8, there is a reduction in flange spread, particularly due to the aforementioned relationship between the various portions of the flange means 40, and additionally the inward angle varies from horizontal to no more than 45 degrees. For some footwear constructions, like welted and flat-lasted cemented, the flange must be horizontal and for vulcanized shoes and boots the flange must extend downward at an angle of up to 45 degrees. In both examples, the flange having a finite significant width, places the resultant force reaction closer to the center-line axis 42 (FIG. 7) thus producing a rotational moment force that tends to reduce the outward deflection of the box 30 (FIG. 4) walls. Thus, it will be seen that the force applied to the box toe element 30 is resisted and, in fact, transferred from the soling material designated schematically at 54 (FIG. 8) through the wider flange means 40 into the box toe structure itself. This results in a greater clearance between the lowermost portion of the deformed box toe element 30' and the top of the sole 54 than is possible with prior art constructions.

Figure 7:
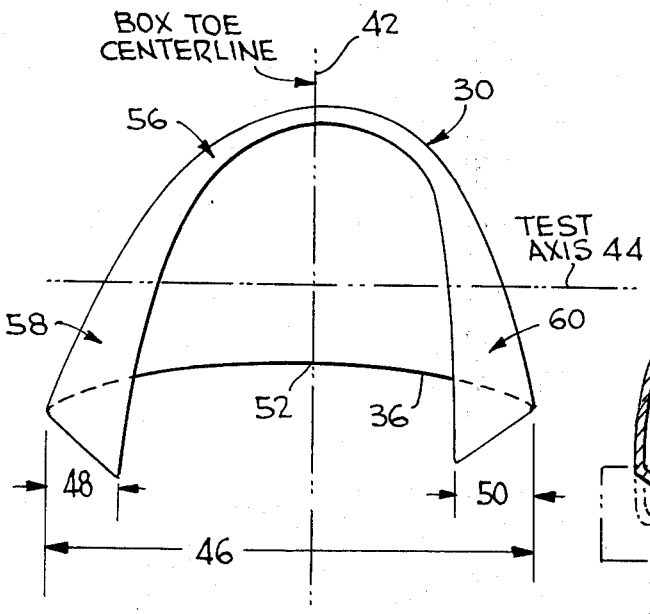
FIG. 7 is a bottom plan view of the "Balanced Flange" safety box toe with the flange means shown in horizontal projection.

The horizontally projected flange areas of the "Balanced Flange38 40 will be best seen in FIG. 7 wherein the portion of the flange area forwardly of the test axis is designated by the reference numeral 56 and the portions of the flange area rearwardly of the test axis 44 are designated by the reference numerals 58 and 60. A critical feature of the instant invention is that the total of the areas 58+60 must be equal to or greater than the total of the area 56, that is, the ratio of the areas 58+60 divided by the area 56 must be equal to or greater than 1.

According to another important feature of the instant invention the maximum transverse width of the flange means 48 or 50 on each side of the element 30 must be no more than 20 percent of the overall width of the element 46 in order to avoid any possibility of a clamping or guillotine effect upon application of external forces which, in addition to causing further injury to the toes of the wearer would make it more difficult to remove the safety toe from the foot after impact.

Although the preferred design of the instant inventive concepts incorporates a continuous flange of constantly increasing width toward the rear it should be understood that the basic inventive concept can be satisfied by other designs so long as the foregoing "Balanced Flange" principle is adhered to. Thus, the projected flange area must be distributed in a fashion that will resist the externally generated rotational forces described previously. This area may be of any shape, including saw-toothed, serrated, tabs for security, etc.

Comparative tests between a shoe incorporating a safety box toe according to the instant inventive concepts with a shoe incorporating a conventional box toe result in significantly improved properties. For example, in one such test according to the American National Standard, all other things being equal, the impact test result with 75 ft/1bs. produced a clearance of 21/32 inches as compared to 19/32 inches with the prior art and utilizing an impact of 100 ft-lbs., a clearance of 17/32 inches resulted with the design of this invention as compared to 15/32 inches with the prior art design, 16/32 inches being the standard for a Class 75 safety shoe. With similar shoes the compression test of the American National Standard resulted in 3940 lbs./in.$^2$ as compared to 1867 lbs./in.$^2$ with a prior art box toe, the standard for Class 75 safety shoes requiring a compression of 2500 lbs/in.$^2$.

Similar improvements have been realized with other shoe constructions comparing the "Balanced Flange" safety box toe of this invention with conventional prior art safety box toes.

Thus, it will now been seen that has been provided herein an improved safety box toe design for use in shoes and/or waterproof boots or the like to be worn by individuals of either sex in such environments as heavy manufacturing, mining, logging and the construction industries. The safety box toe of this invention will reduce injuries to the feet of wearers from moving, falling or rolling objects which may come in contact with the toe area of the shoe by resisting the application of such external forces. Further, the design of this invention eliminates rearward clearance-reducing rotation of the safety box toe and flange spreading by providing additional design stiffening to the flanges of the safety box toe. The "Balanced Flange" principle additionally increases the bearing area which, in turn, increases the load carrying capacity of the safety box toe and the design of this invention further minimizes the punching action of prior art safety box toes while improving the interlocking integration of the safety box toe into the safety footwear.

The embodiments of the invention in which an exclusive property or privilege is claimed are defined as follows:

1. In a safety box toe for use in shoes and the like including a relatively rigid stiffener element having a closed front end portion and an open rear end portion terminating in a back edge, the distance between the lower-most portions of said back edge defining the overall width of said element and the longitudinal center of said back edge defining the highest point of said element, said element being of a generally inverted U-shaped in transverse cross-section and including lower edge portions extending generally horizontally in use with flange means extending inwardly from said lower edge portions, and an imaginary test axis extending transversely of said element spaced forwardly of said highest point of said back edge by a predetermined amount in accordance with American National Standards, the improvement which comprises the total of the horizontally projected areas of said flange means rearwardly of said test axis being at least equal to the total of the horizontally projected areas of said flange means forwardly of said test axis, and the maximum transverse width of said flange means on each side of said element being no more than 20 percent of said overall width of said element.

2. The box toe of claim 1 wherein said element is formed of metal.

3. The box toe of claim 1 wherein said flange means is continuous.

4. The box toe of claim 3 wherein said flange means increases in width from said front end portion of said rear end portion of said element.

5. The box toe of claim 1 wherein said flange means extends downwardly from said lower edge portions at an angle of no more than 45 degrees from the horizontal.

6. The box toe of claim 1 wherein said imaginary test axis is spaced forwardly of said highest point of said back edge by one-half inch.

* * * * *